US006267684B1

(12) United States Patent
Luhm

(10) Patent No.: US 6,267,684 B1
(45) Date of Patent: Jul. 31, 2001

(54) RIVETS AND RIVET MANUFACTURING METHODS

(75) Inventor: Ralph Luhm, La Habra, CA (US)

(73) Assignee: Allfast Fastening Systems, Inc., City of Industry, CA (US)

( * ) Notice: Subject to any disclaimer, the term of this patent is extended or adjusted under 35 U.S.C. 154(b) by 0 days.

(21) Appl. No.: 09/186,711

(22) Filed: Nov. 5, 1998

Related U.S. Application Data

(63) Continuation-in-part of application No. 08/846,273, filed on Apr. 30, 1997, now abandoned.

(51) Int. Cl.[7] ..... B21H 3/02

(52) U.S. Cl. ..... 470/16; 470/28; 470/31; 72/267

(58) Field of Search ..... 470/16, 28, 31; 72/267, 352, 358, 359

(56) References Cited

U.S. PATENT DOCUMENTS

| | | | | |
|---|---|---|---|---|
| 2,017,341 | | 10/1935 | Cummins . | |
| 2,030,290 | * | 2/1936 | Friedman | 470/16 |
| 2,395,721 | | 2/1946 | Buchet . | |
| 2,436,185 | | 2/1948 | Torresen . | |
| 2,621,344 | | 12/1952 | Friedman . | |
| 2,779,955 | | 2/1957 | Curtis . | |
| 3,072,933 | | 1/1963 | Carlson . | |
| 3,126,561 | | 3/1964 | Orloff . | |
| 3,253,287 | * | 5/1966 | Friedman | 470/16 |
| 3,555,874 | | 1/1971 | Kuhn . | |
| 3,626,531 | * | 12/1971 | Mazar et al. | 470/31 |
| 3,771,480 | | 11/1973 | Johnson . | |
| 3,975,786 | | 8/1976 | Gapp et al. . | |
| 3,978,538 | | 9/1976 | Fick . | |
| 4,023,225 | | 5/1977 | Tochilkin et al. . | |
| 4,059,860 | | 11/1977 | Fick . | |
| 4,136,417 | | 1/1979 | Dahmen et al. . | |
| 4,245,921 | | 1/1981 | Falcioni . | |
| 4,296,512 | | 10/1981 | Kilinskas et al. . | |
| 4,366,588 | | 1/1983 | Garlaschi . | |
| 4,395,899 | | 8/1983 | Wisebaker . | |
| 4,425,067 | | 1/1984 | Krezak . | |
| 4,586,231 | | 5/1986 | Powderley et al. . | |
| 4,620,886 | | 11/1986 | Wincierz et al. . | |
| 4,928,375 | | 5/1990 | Hadaway . | |
| 5,944,918 | * | 8/1999 | Keener | 148/251 |

FOREIGN PATENT DOCUMENTS

| | | |
|---|---|---|
| 0863220A1 | 9/1998 | (EP) . |
| 1117017 | 5/1956 | (FR) . |
| 336803 | 10/1930 | (GB) . |
| 1152-702 | 4/1985 | (SU) . |

* cited by examiner

*Primary Examiner*—Ed Tolan
(74) *Attorney, Agent, or Firm*—Blakely, Sokoloff, Taylor & Zafman LLP

(57) ABSTRACT

The present invention comprises aluminum solid rivets and methods of manufacturing aluminum solid rivets for aircraft and other demanding applications to provide rivets with high strength and excellent driveabiltity while improving the rivets resistance to fatigue and stress corrosion cracking. In accordance with the method, an aluminum rivet blank approximately the same diameter as the head of the finished rivet is used. This rivet blank is forced into a die to extrude the tapered region and the shank of the finished rivet. The fabrication process provides more uniform cold working at the junction of the shank and the tapered region of the rivet, and better orients the flow lines in this region. The process also can provide a superior surface finish, and may be suitable for use in wet wing fabrication without further processing for improved surface finish. Alternate embodiments are disclosed.

38 Claims, 5 Drawing Sheets

UPSET METHOD

EXTRUSION METHOD

RIVETS AND RIVET MANUFACTURING METHODS

This application is a continuation-in-part of application Ser. No. 08/846,273, filed Apr. 30, 1997, entitled "Rivet Fabrication Method now abandoned."

BACKGROUND OF THE INVENTION

1. Field of the Invention

The present invention relates to the field of rivets, and more particularly to a method of manufacture of aluminum solid rivets for aircraft and other high performance and high endurance applications.

2. Prior Art

Of particular interest to the present invention are rivets having a tapered or conical region extending from the shank of the rivet, usually integrally joining the shank to a substantially cylindrical rivet head. Rivets of the general type described are used in large quantities in such applications as in wet wing structures. In these applications, the rivet heads expand radially during setting of the rivets so that the periphery of the rivet heads seal with respect to corresponding countersunk holes in one of the skin members to be joined.

Solid rivets, whether for aircraft use as described above, or for other uses, are generally fabricated in large numbers starting with a wire, rod or bar of material of substantially the same diameter as the desired shank of the finished rivet. In fabrication, the rod is cut off, the end of the rod is inserted into the die defining the rivet, and then typically given an initial upset, followed by a final blow to form the head and tapered region between the head and shank of the rivet.

In modern aircraft applications, solid rivets may be subjected to relatively high repetitive loads due to repeated pressurization and depressurization of the cabin, the flexing of structures due to turbulence, takeoffs and landings, engine and other equipment vibration, etc. Further, modern jet aircraft tend to have a high usage factor and are generally maintainable almost indefinitely, tending to bring out some undesired characteristics of components such as solid rivets, heretofore considered relatively indestructible.

In particular, it has been noted that after long service, the heads, or portions of the heads, of some solid rivets will simply fall off, requiring replacement of the rivets. Inspection of the end of the remaining rivet shank indicates that such failures are frequently due to fatigue and/or stress corrosion cracking at the juncture between the shank and the tapered region. (Stress corrosion is an accelerated corrosion caused by substantial stresses on a part, a material under stress normally corroding substantially faster than the same material in the same environment but not under stress. Fatigue, on the other hand, is caused by the cycling of stresses, eventually causing a surface crack to develop and then progress through the part until the same fails.)

The prior art method of fabricating solid rivets, and particularly aluminum aircraft solid rivets, for installation into a countersunk hole in the work pieces as described above, is illustrated with reference to FIGS. 1 through 4. In particular, FIG. 1 is a cross-section of a typical prior art die 20 defining a cylindrical rivet head region 22, a shank region 24 and a tapered region 26 connecting the shank region 24 with the head region 22. This die is used in a header machine, typically a two blow header, which automatically feeds and shears a length of wire, bar or rod 28 and places same into the forming die, as shown in FIG. 2. As may be seen therein, the resulting rivet blank 28 is of a diameter approximately equal to the rivet shank diameter as defined by region 24 of the die 20. On the first header blow, head 30 of the rivet will be partially formed as shown in FIG. 3, and then as shown in FIG. 4, a second blow will finish the rivet, the rivet then being expelled from the die by an ejection pin inserted through opening 32 at the shank end of the die.

The foregoing method of manufacturing rivets is fast and inexpensive, and is capable of providing rivets of good dimensional accuracy. However, as more and more is expected of such rivets, it would be desirable to reduce or eliminate the potential for fatigue or stress corrosion cracking resulting from prolonged use. Also in the case of aircraft rivets used in the fabrication of wet wing structures (aircraft wings wherein the wing skin also forms an exterior wall of a fuel tank as mentioned above), longitudinally oriented marks on the surface of rivets can provide fuel leak paths in the set rivet. Consequently, either the leaking rivets must be drilled out and replaced, or extra and expensive processing must be undertaken during the rivet manufacture, such as first fabricating the rivets oversize, and then profile grinding the same to remove the surface imperfections and to provide a smooth surface that will set without leaking. Alternatively, the rivet wire used in the fabrication of solid rivets can be shaved prior to use in forming rivets to remove any longitudinal surface imperfections caused by the drawing of the wire, such as a double shave by running the raw material through diamond dies. Still, the occurrence of leakers is not eliminated, and as such, shaving has heretofore had limited success.

BRIEF SUMMARY OF THE INVENTION

The present invention comprises aluminum solid rivets and methods of manufacturing aluminum solid rivets for aircraft and other demanding applications to provide rivets with high strength and excellent driveabiltity while improving the rivets' resistance to fatigue and stress corrosion cracking. In accordance with the method, an aluminum rivet blank approximately the same diameter as the head of the finished rivet is used. This rivet blank is forced into a die to extrude the tapered region and the shank of the finished rivet. The fabrication process provides more uniform cold working at the junction of the shank and the tapered region of the rivet, and better orients the flow lines in this region. The process also can provide a superior surface finish, and may be suitable for use in wet wing fabrication without further processing for improved surface finish. Alternate embodiments are disclosed.

DETAILED DESCRIPTION OF THE INVENTION

The present invention comprises a method of forming solid aluminum rivets to improve the rivets' resistance to fatigue and stress corrosion cracking. The invention is particularly applicable to aircraft rivets, and in the preferred embodiment, to aircraft rivets of the countersunk type, wherein a cylindrical shank and cylindrical head are used, joined by a tapered region typically providing a straight taper from the head region to the shank region. Such rivets are commonly used in the fabrication of wet wings for commercial aircraft, wherein such rivets are regularly subjected to high and variable stresses, environmental exposure and the potential for fuel leaks.

While the fabrication of a flat headed rivet is described, it is to be recognized that the method in accordance with the present invention may be used to form heads of other configurations, such as by way of example, dome headed rivets and ring dome rivets, to name but two other types well known in the art.

Figure 1:
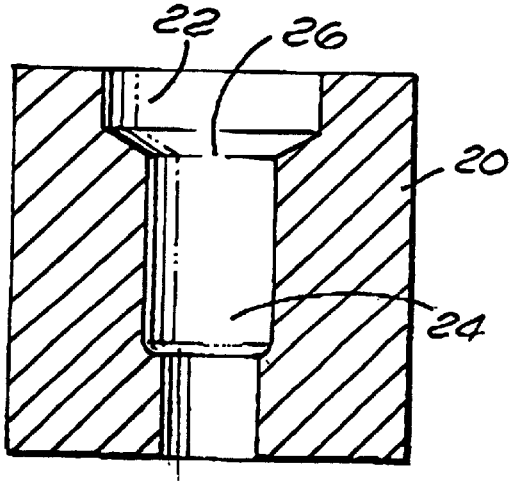
FIG. 1 PRIOR ART
FIG. 1 is a cross-section of a typical prior art die defining a cylindrical rivet head region, a shank region and a tapered region connecting the shank region with the head region.
Figure 2:
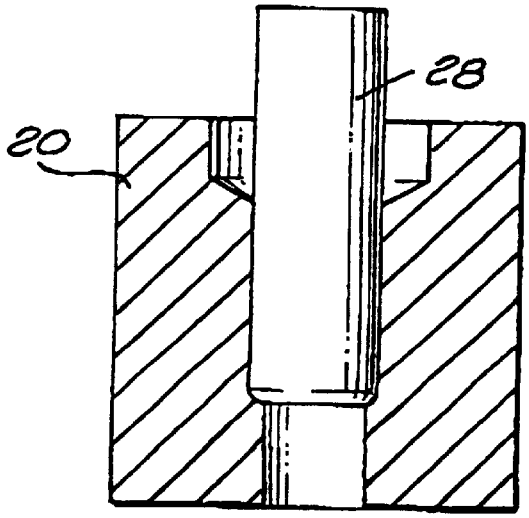
FIG. 2 PRIOR ART
FIG. 2 is a cross section of the prior art die of FIG. 1 showing a prior art rivet blank therein having a diameter approximately equal to the diameter of the finished rivet shank.
Figure 3:
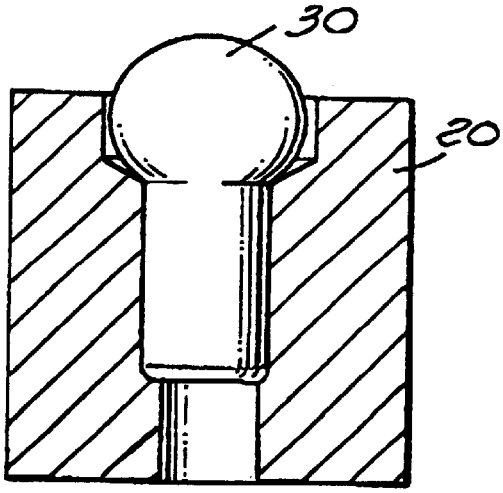
FIG. 3 PRIOR ART
FIG. 3 is a cross section of the prior art die of FIG. 1 showing a prior art rivet blank therein as partially formed.
Figure 4:
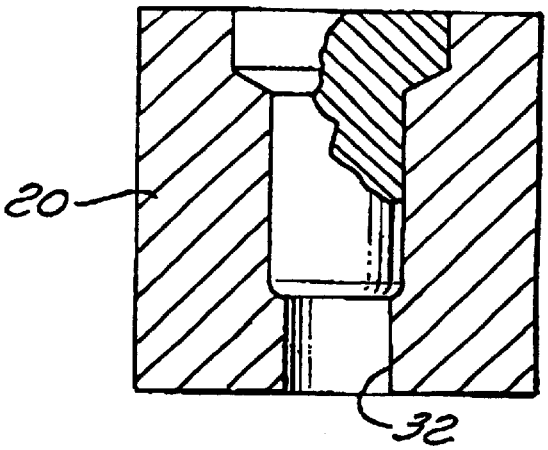
FIG. 4 PRIOR ART
FIG. 4 is a cross section of the prior art die of FIG. 1 showing a fully formed prior art rivet therein.
Figure 5:
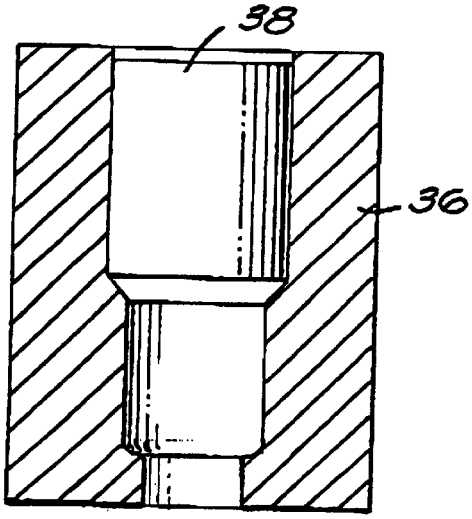
FIG. 5 is a cross-section of an exemplary die in accordance with the present invention showing a rivet blank therein having a diameter substantially equal to the diameter of the finished rivet head.
Figure 6:
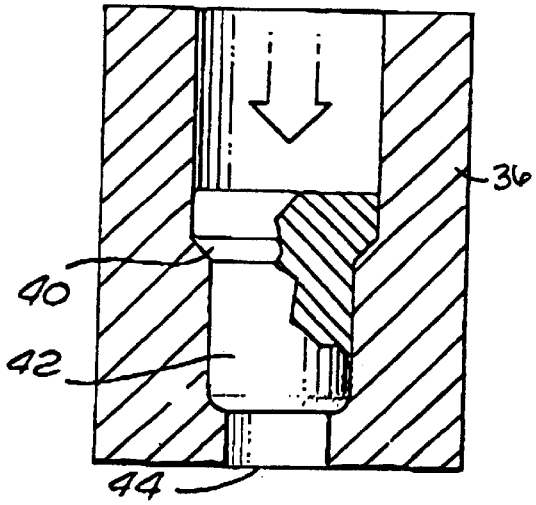
FIG. 6 is a cross section of the die of FIG. 5 showing a fully formed rivet therein.

In accordance with the method and as shown in FIG. 5, a die is provided defining the head region, the shank and the tapered region of the finished rivet. In accordance with the method, however, a rivet blank 38, cut from a wire, rod or bar of rivet material of a diameter approximately equal to the diameter of the finished rivet head, not the shank, is provided. Then, as shown in FIG. 6, on a single blow of a header machine, a substantial fraction of the rivet blank 38 is extruded by the tapered region 40 of the die 36 to form the shank 42 of the rivet, and of course the tapered region between the head and shank. The finished rivet may be expelled by an ejection pin extending upward through the bottom opening 44 in the die.

Figure 7:
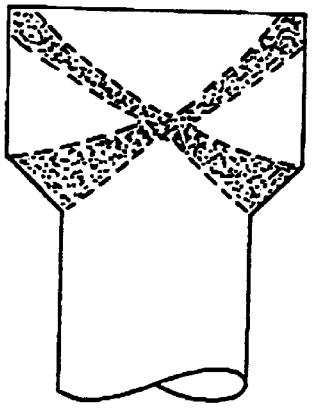
FIG. 7 illustrates the bow tie like variation of the cold working in the tapered region and head of rivets formed by the prior art method.

The present invention recognizes that a sudden change in cross sectional area of a load bearing member will typically cause a stress concentration at the change of area. Further, a change in material characteristics at a particular location of a stress carrying member may also cause stress concentration. In the prior art wherein the starting rivet blank has a diameter substantially equal to the diameter of the shank of the finished rivet, there is very little cold working of the shank. Instead, the cold working begins at the junction between the shank and the tapered region. Also, material flow in this region would appear to be not as well defined and repeatable as might be expected, perhaps due to variations in the clearance between the rivet blank and the shank forming portion of the die, the material itself, or some other reason or reasons. In any event, the cold working in the tapered region tends to have a bow tie like variation around the circumference of the tapered region and head, being greater in some regions than in other regions, as shown in FIG. 7. This occurs as a result of certain regions of the material displacing substantially as a unit during forming, while the areas between these regions are subjected to extraordinary cold working to accommodate the movement of these regions. The net effect is that the extraordinary change in the cold working adjacent the junction between the shank and the tapered region is also the region that in use is highest in stress and variations in stress in the rivet, whether due to tensile load or shear load.

Figure 8:
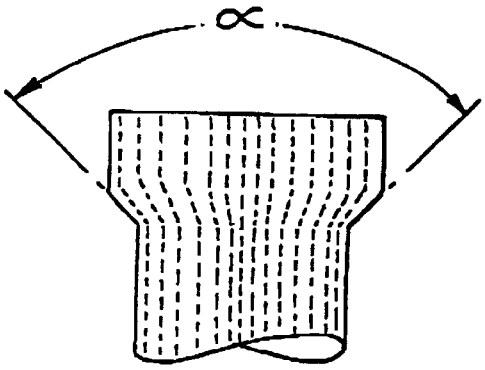
FIG. 8 illustrates the flow lines in rivets manufactured in accordance with the present invention methods.

In the present invention, the tapered region and the shank are formed by extruding the rivet blank into the die. The net result of this is that the flow of material down the tapered region and into the shank region of the die is relatively uniform so that upon forming the finished rivet, both the shank and the tapered region have substantial cold working. Further, the flow in both the tapered region and in the shank is in a generally longitudinal direction, the flow adjacent the surface of the rivet of course generally following the die contour, yielding flow lines as shown in FIG. 8.

Thus, the material characteristics in the tapered region adjacent the shank more closely approximate the characteristics of the material in the shank, both being substantially cold worked, so as to avoid enhancement of the natural stress concentration in this area and to improve that region's resistance to both fatigue and stress corrosion cracking.

In the present invention, the head of the finished rivet will have minimal cold working and the junction between the region of low cold working and of higher cold working will be moved to the region between the head and the tapered region, and will be more gradual. This has at least two advantages over the rivets of the prior art. First, a substantial part of the tensile load on the shank will already have been transferred by the tapered region on the rivet to the adjoining work piece. This is particularly true in the case of tension, as the head region merely provides better rigidity for the tapered region of the rivet. With respect to shear, shear too will result in some increase in tension on the shank, most of which will be transferred to the work piece by the tapered region of the rivet. Further, since the head or the junction between the head and the tapered region is of substantially bigger area than the junction between the tapered region and the rivet shank, the stress as caused by such loads will be significantly reduced over those of the prior art.

In accordance with the present invention, it is preferred that the amount of extrusion required not be excessive and that the tapered region for mating with the countersink in one of the work pieces to be joined by the rivet be tapered enough to readily facilitate the required material flow in the extrusion process. For this purpose, the cross sectional area reduction from head to shank should not be excessive, particularly with relation to the taper of the tapered region. It is believed that reasonable limits are approximately as follows:

| Included angle α of tapered region (See FIG. 8) | Area reduction Head to shank | Diameter ratio Shank to head |
|---|---|---|
| <90° | <40% | >77% |
| >90° | <25% | >87% |

Figure 10:
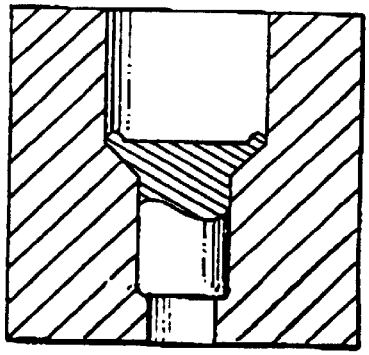
FIG. 10 is a cross section of a die showing a fully formed rivet in accordance with FIG. 9 therein.

Also, note that in FIGS. 5 and 6, as well as in FIG. 10, the rivet is formed entirely within die 36, and that this is true also for FIGS. 11*a* and 11*b*, though in the later case, the top of the head of the fully extruded rivet may be flush with the top of the die. This may be important, as any die parting line part way down the head of the rivet may require the removal of more material to obtain finished rivet dimensions if the formed rivets are to be centerless ground to finished dimensions, or is likely to prevent obtaining rivets to finished dimensions without centerless grinding for use in critical applications, such as in the fabrication of wet wing structures.

Figure 12:
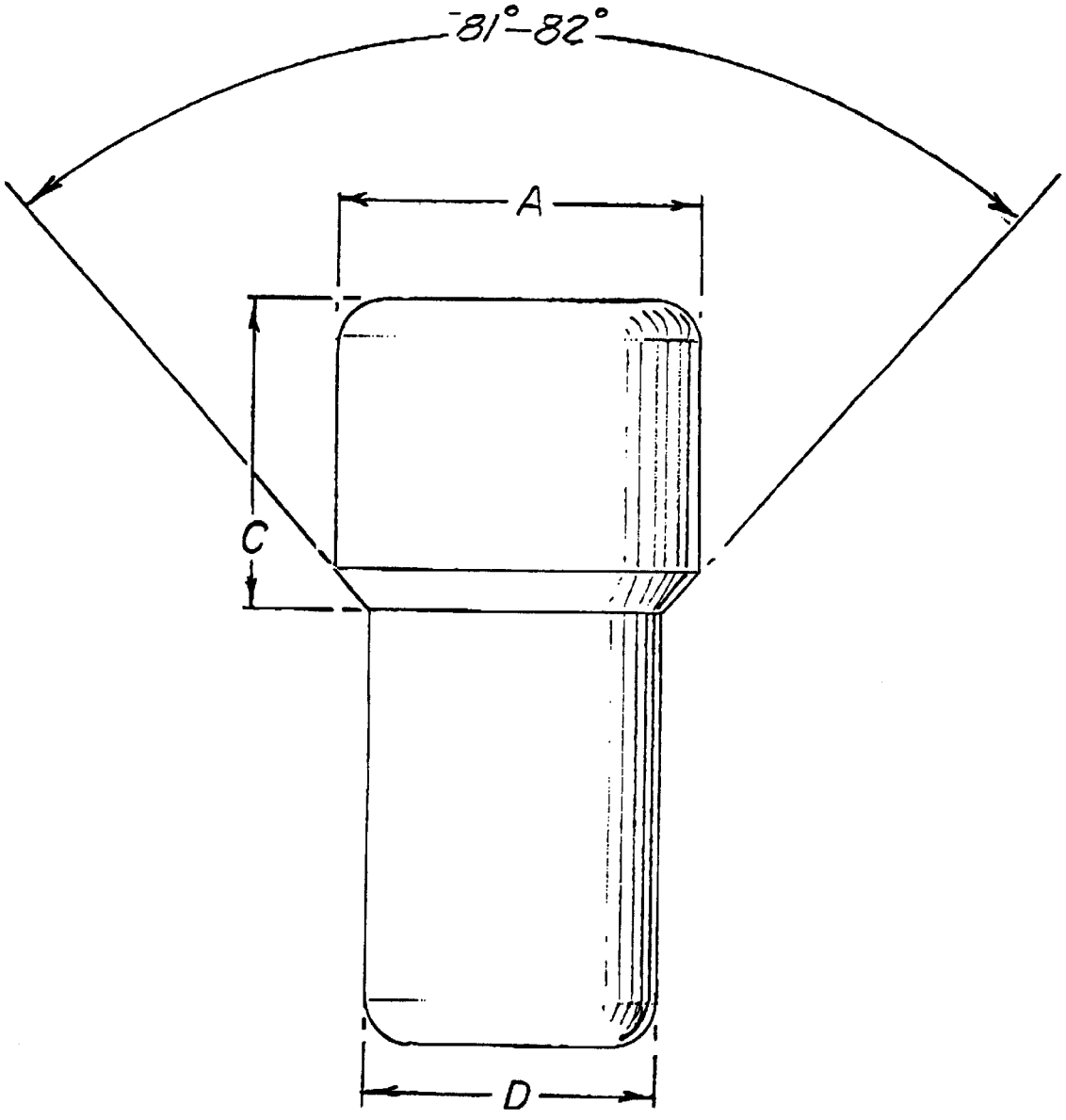
FIG. 12 is a drawing of a typical rivet which may be advantageously fabricated using the present invention methods.

One specific aluminum rivet which may be advantageously manufactured in accordance with the present invention method is shown in FIG. 12. This rivet is generally in accordance with Boeing drawing BACR15GH and is used in large quantities in various lengths and sizes in the fabrication of wet wing structures. The following table sets forth various dimensions and tolerances for this rivet. The wet wing application further requires that the rivets when set must be fluid tight. While this rivet has a conical section angle of 81°–82° as shown in FIG. 12, other angles may be used as herein before indicated, angles in the range of 80° to 85° being preferred for some rivets.

| Size | Nominal rivet diameter | Diameter A +.000 −.005 | C ±.005 | D +.0020 −.0000 |
|---|---|---|---|---|
| 5 | .156 | .193 | .165 | .1560 |
| 6 | .187 | .240 | .180 | .1870 |
| 8 | .250 | .320 | .210 | .2500 |
| 10 | .312 | .385 | .240 | .3120 |
| 12 | .375 | .440 | .260 | .3750 |
| 14 | .437 | .505 | .280 | .4370 |

The sizes in the foregoing table are nominal sizes in 32nds of an inch, size 5 being 5/32 or 0.156 in diameter, etc. It may be noted that for rivet sizes in the 5 to 10 range, the ratio of the nominal area of the shank to the nominal area of the head is in the range of approximately 60 to 67%, while for the larger rivet sizes of 12 and 14, the ratio of the nominal area of the shank to the nominal area of the head is in the range of approximately 72 to 75%, or for the full range of sizes, the ratio of the nominal area of the shank to the nominal area of the head is in the range of approximately 60 to 75%.

The preferred processes for fabrication of rivets of this type of rivet are as follows. If the rivets are to be centerless ground after formation, the rivet extruding die for rivet formation would preferably be approximately 0.006 inches over the nominal finished rivet dimensions. The rivet wire (raw material) from which the rivets would be formed would preferably be somewhat less than the die diameter for the rivet head, such as preferably approximately 0.002 inches over the nominal finished rivet head diameter. The raw material would be uncoated and have a grain oriented longitudinally along the rivet wire to enhance the desired grain orientation in the finished rivet, as in a rolled or extruded wire. For extruding the rivet, a light lubricant may be used, though is sufficiently small quantities and of sufficiently low viscosity to not effect dimensions in the finished rivet.

For 2017, 2024, 2117 and 7050, the preferred rivet raw materials and rivet manufacturing processes are:

Raw Material: 2017-H15
Per QQ-A-430
Manufacturing Sequence
Form rivet by shearing length of raw material and extruding
Clean
Heat Treat 935° F., 45 Minutes, Water Quench
Age 96 Hours at Room Temperature
Centerless Grind
Clean
Finish Anodize, Dye Blue
Final Inspect
Package Raw Material: 2024-H13
Per QQ-A-430
Manufacturing Sequence
Form rivet by shearing length of raw material and extruding
Clean
Heat Treat 920° F., 45 Minutes, Water Quench
Age 96 Hours at Room Temperature
Centerless Grind
Clean
Finish Anodize, Clear Seal
Final Inspect
Package Raw Material: 2117-H15
Per QQ-A-430
Manufacturing Sequence
Form rivet by shearing length of raw material and extruding
Clean
Heat Treat 935° F., 45 Minutes, Water Quench
Age 96 Hours at Room Temperature
Centerless Grind
Clean
Finish Anodize, Dye Orange
Final Inspect
Package Raw Material: 7050-H13
Per QQ-A-430
Manufacturing Sequence
Form rivet by shearing length of raw material and extruding
Clean
Heat Treat 890° F., 45 Minutes, Water Quench
Age 250° F. for 8 Hours, then 355° F. for 12 Hours
Centerless Grind
Clean
Finish Anodize, Dye Purple
Final Inspect
Package Because of the extrusion process used in the present invention, use of a polished rivet forming die will tend to smoothen rather than roughen the outer surface of the rivet material during rivet formation. Therefore it may be possible to form leak proof rivets to the finished dimensions without the centerless grinding, without, or more likely with, raw material which itself is substantially free of longitudinal surface defects, such as material which is shaved as herein before described. If the rivets are not to be centerless ground after formation, but are to be formed to the finished dimensions, the rivet extruding die for rivet formation would preferably be approximately the nominal finished rivet dimensions. The rivet wire (raw material) from which the rivets would be formed would preferably be somewhat less than the die diameter for the rivet head, such as preferably approximately 0.002 inches under the nominal finished rivet head diameter. For 2017, 2024, 2117 and 7050, the preferred rivet raw materials would be as previously described, though perhaps preprocessed for improved surface finish, and rivet manufacturing processes would be as previously described except the centerless grinding operation would be eliminated. In any event the grain size would preferably be 6 or finer in accordance with specification ASTM E 112.

Figure 9:
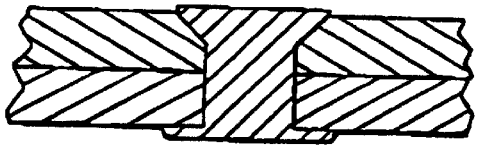
FIG. 9 illustrates another form of rivet which may be fabricated in accordance with the present invention, intended to be inserted into a simple tapered countersunk hole in the work pieces and set so as to have a substantially flat surface terminating the taper.

Certain preferred embodiments of the present invention have been described with respect to the manufacture of rivets characterized by a shank, a head and a tapered region joining the shank and head. In some rivets, the extent of the head is minimal, being intended to be inserted into a simple tapered countersunk hole in the work pieces and set so as to have a substantially flat surface terminating the taper. Such an installed rivet is shown in cross section in FIG. 9. Rivets of this type may also be manufactured by the present invention method. Such rivets are normally manufactured with a slightly smaller maximum diameter tapered region, with a lip or raised region of some kind near the tapered region outer diameter, which region will deform outward on setting of the rivet to provide the flat head of the installed rivet. This allows the rivets to be manufactured in a header machine as described herein without the forming tool bottoming on the die. This also is applicable to the present invention, as illustrated in FIG. 10. Again, the precise head configuration may be varied as desired, though here the larger diameter of the die is equal to the outer diameter of the tapered region, not the diameter of the flat head of the installed rivet.

Figure 11B:
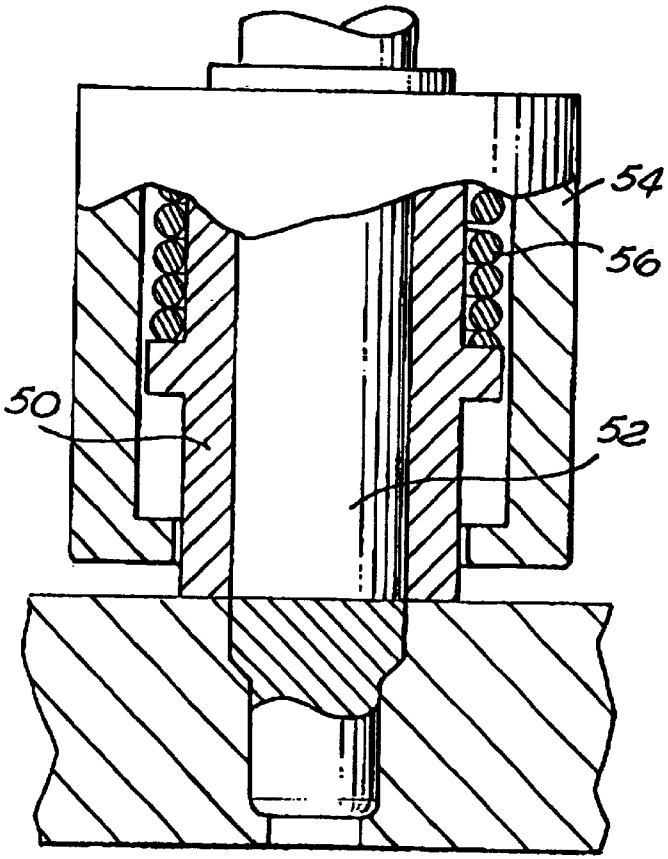
FIGS. 11*a* and 11*b* are illustrations of alternate tooling for the fabrication of rivets in accordance with the present invention.
Figure 11A:
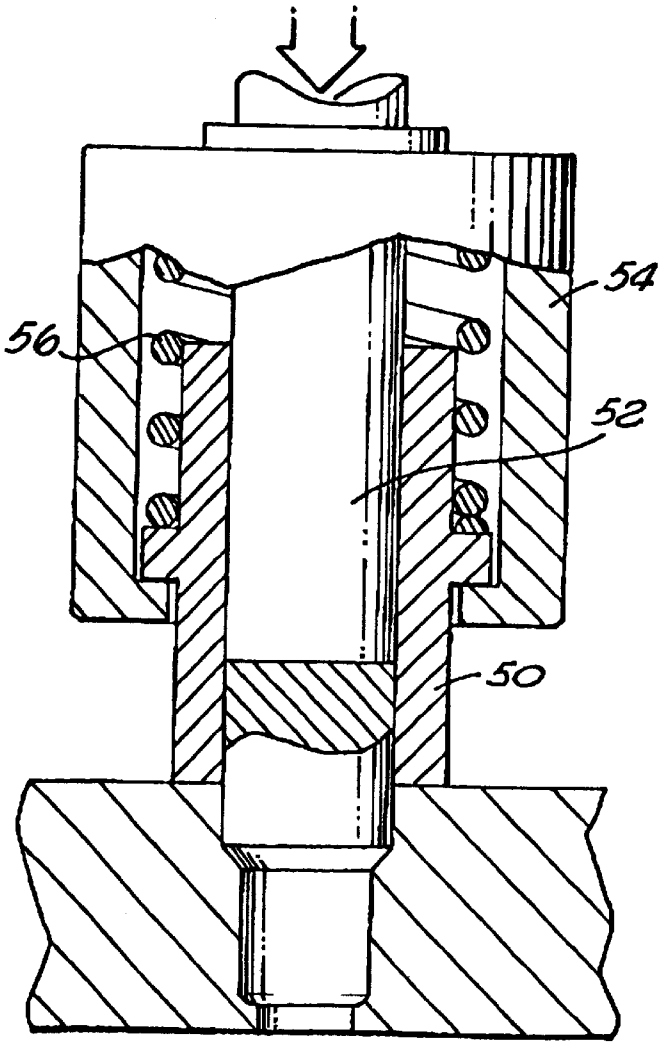

FIGS. 11*a* and 11*b* illustrate an exemplary alternate form of tooling which may be used with the present invention method. In this form of tooling, a floating upset 50 is retained relative to the hammer 52 by a retainer 54, and is spring loaded toward the die by spring 56. Thus initially, as shown in FIG. 11*a*, the majority of the rivet material is confined by the floating upset, the hammer 52 ultimately forcing the material out of the upset when the rivet is formed while the floating upset is held tight against the die 54 by spring 56.

Figure 13A:
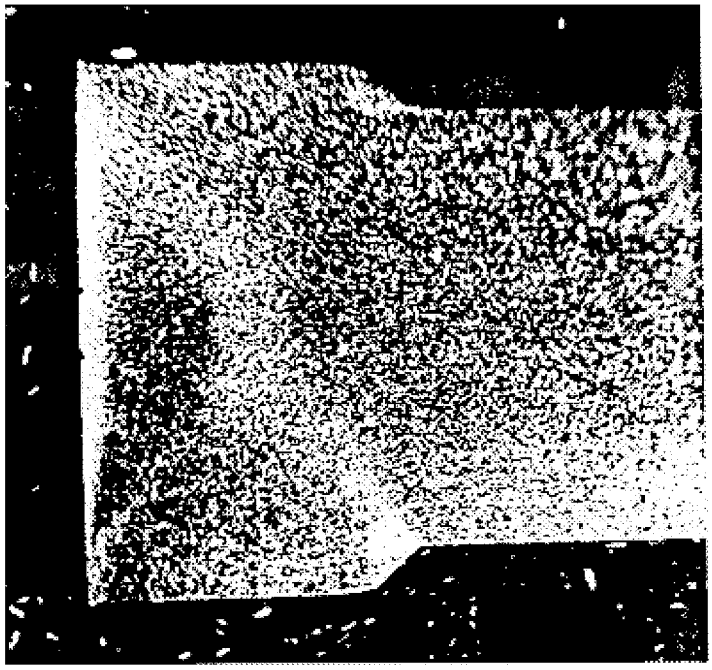
FIGS. 13*a* and 13*b* are photomicrographs of cross sections of aluminum rivets fabricated using the prior art upset method and the present invention methods, respectively.
Figure 13B:
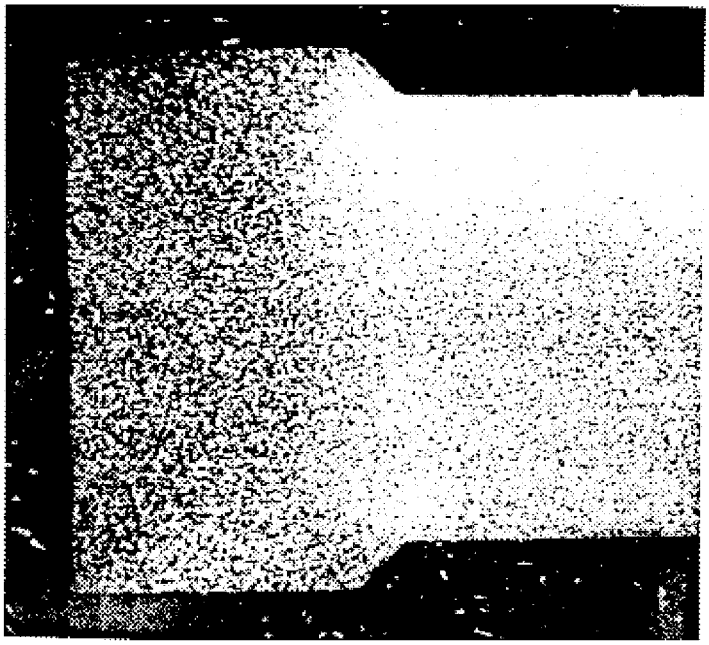

It was previously mentioned that the prior art method of making solid rivets causes a bow tie like variation of the cold working in the tapered region and head of the rivets so formed, as illustrated in FIG. 7. This is graphically illustrated in the photomicrograph of a rivet formed by the prior upset method (starting with raw material substantially at the shank diameter and upsetting the same to form the rivet head) shown in FIG. 13*a*. This Figure is a photomicrograph of a sectioned, finished rivet taken in the normal manner, namely by potting a fully processed rivet (see the above processing steps) in plastic, sectioning the same, then polishing and etching the section so taken to bring out the grain structure. For the aluminum rivets, Kellers etch is used, as is well known in the art. In comparison, FIG. 13*b* is a corresponding section of a fully processed rivet manufactured in accordance with the present invention. These sections clearly illustrate the differences on the finished rivets, FIG. 13*a* clearly illustrating the bow tie herein before referred to and FIG. 13*b* clearly showing an absence of such a bow tie grain structure. The difference in such rivets can be summarized as the difference between the presence and the absence of the bow tie like grain structure variation. It may also be characterized by the fact that the grain structure variation in the longitudinal direction (along lines parallel to the axis of the rivets) is not substantially the same for all such parallel lines. It may also be characterized by the fact that the grain structure variation in the longitudinal direction is not monotonic for such parallel lines. The same comments apply if instead of considering lines parallel to the axis of the rivets, one considers theoretical flow lines for a theoretically uniform or orderly flow of material during rivet forming. In the prior art upset method, such flow lines are clearly theoretical, as the bow tie effect is believed due to the absence of uniformity in the flow across the rivet head and tapered region. In the present invention method, the flow is obviously substantially uniform, providing the characteristics desired. In that regard, FIG. 13*b* appears lighter on one side of the rivet shank than on the other. This is the result of the lighting used when the photomicrograph was taken, and is not characteristic of the grain structure of the rivet itself.

While preferred embodiments of the present invention have been disclosed and described herein, it will be obvious to those skilled in the art that various changes in form and detail may be made therein without departing from the spirit and scope of the invention.

What is claimed is:

1. A method of producing a fluid sealing, solid metal rivet comprising:

providing an extrusion die, said extrusion die having a head portion defining a head cylindrical opening with a head diameter, a tapered portion defining a tapered opening extending from the head cylindrical opening, said tapered opening having a polished conical surface, and a shank portion defining a shank cylindrical opening extending from the tapered opening, said shank cylindrical opening having a polished shank cylindrical surface;

providing a metal slug having a slug cylindrical surface, a uniform slug diameter approximately equal to the head diameter, and a grain oriented substantially longitudinally along the axis of the metal slug;

preprocessing the slug cylindrical surface to provide a surface that is substantially free of longitudinal surface defects;

extruding the metal slug through the extrusion die from the head portion toward the shank portion to form a solid metal rivet having a head with the head diameter and a shank with a shank diameter connected by a tapered region;

said solid metal rivet being characterized by the surfaces of the shank and the tapered region being suitable for making a fluid tight assembly.

2. The method of claim 1 wherein preprocessing further comprises shaving the slug cylindrical surface.

3. The method of claim 1 wherein said tapered opening has an included angle in a range of 30° to 90°.

4. The method of claim 1 wherein said tapered opening has an included angle in a range of 80° to 85°.

5. The method of claim 1 wherein said shank diameter is between 77% and 87% of the head diameter.

6. The method of claim 1 wherein said metal slug has a grain size of 6 or finer when measured in accordance with specification ASTM E 112.

7. The method of claim 1 wherein said metal slug is comprised of a metal selected from a group consisting of aluminum and aluminum alloys.

8. The method of claim 1 wherein said metal slug is comprised of a metal selected from a group consisting of 2017, 2024, 2117, and 7050 type aluminum alloys.

9. The method of claim 1 wherein said metal slug is comprised of a metal selected from a group consisting of 2017-T4, 2024-T4, 2117-T4, and 7050-T73 type aluminum alloys.

10. The method of claim 1 wherein said solid metal rivet is further characterized by a grain structure variation that is substantially the same along lines substantially parallel to the common axis of the head, the shank, and the tapered region.

11. A method of producing a fatigue resistant, fluid sealing, solid metal rivet comprising:

providing an extrusion die, said extrusion die having
- a head portion defining a head cylindrical opening with a head diameter,
- a tapered portion defining a tapered opening extending from the head cylindrical opening, said tapered opening having a polished conical surface, and
- a shank portion defining a shank cylindrical opening extending from the tapered opening, said shank cylindrical opening having a polished shank cylindrical surface;

providing a metal slug comprised of an aluminum alloy and having
- a slug cylindrical surface,
- a slug diameter approximately equal to the head diameter,
- a grain oriented substantially longitudinally along the axis of the metal slug, and
- a grain size of 6 or finer when measured in accordance with specification ASTM E 112;

preprocessing the slug cylindrical surface to provide a surface that is substantially free of longitudinal surface defects;

extruding the metal slug through the extrusion die from the head portion toward the shank portion to form a solid metal rivet having a head with the head diameter and a shank with the shank diameter connected by a tapered region;

said solid metal rivet being characterized by a grain structure variation that is substantially the same along lines substantially parallel to the common axis of the head, the shank, and the tapered region, and by the surfaces of the shank and the tapered region being suitable for making a fluid tight assembly.

12. The method of claim 11 wherein said tapered opening has an included angle in a range of 30° to 90°.

13. The method of claim 11 wherein said tapered opening has an included angle in a range of 80° to 85°.

14. The method of claim 11 wherein said tapered opening has an included angle of 81.5°.

15. The method of claim 11 wherein said shank diameter is between 77% and 87% of the head diameter.

16. The method of claim 11 wherein said shank diameter is approximately 80% of the head diameter.

17. The method of claim 11 wherein said tapered opening has an included angle in a range of 80° to 85° and said shank diameter is between 77% and 87% of the head diameter.

18. The method of claim 11 wherein said tapered opening has an included angle of 81.5° and said shank diameter is approximately 80% of the head diameter.

19. The method of claim 11 wherein preprocessing further comprises shaving the slug cylindrical surface.

20. The method of claim 11 wherein the aluminum alloy is comprised of a metal selected from a group consisting of 2017-T4, 2024-T4, 2117-T4, and 7050-T73 type aluminum alloys.

21. A method of producing a fatigue resistant, solid metal rivet comprising:

providing an extrusion die, said extrusion die
- having a head portion defining a head cylindrical opening with a head diameter,
- having a tapered portion defining a tapered opening extending from the head cylindrical opening, said tapered opening having an included angle in a range of 30° to 90°, and
- having a shank portion defining a shank cylindrical opening extending from the tapered opening;

providing a metal slug
- having a slug cylindrical surface,
- having a uniform slug diameter approximately equal to the head diameter, and
- having a grain oriented substantially longitudinally along the axis of the metal slug;

extruding the metal slug through the extrusion die from the head portion, through the tapered portion, and into the shank portion to form a solid metal rivet having a head with the head diameter, a shank with a shank diameter, and connected by a tapered region;

said solid metal rivet being characterized by a grain structure variation that is substantially the same along lines substantially parallel to the common axis of the head, the shank, and the tapered region.

22. The method of claim 21 wherein said tapered opening has an included angle in a range of 80° to 85°.

23. The method of claim 21 wherein said shank diameter is between 77% and 87% of the head diameter.

24. The method of claim 21 wherein said metal slug has a grain size of 6 or finer when measured in accordance with specification ASTM E 112.

25. The method of claim 21 wherein said metal slug is comprised of a metal selected from a group consisting of aluminum and aluminum alloys.

26. The method of claim 21 wherein said metal slug is comprised of a metal selected from a group consisting of 2017, 2024, 2117, and 7050 type aluminum alloys.

27. The method of claim 21 wherein said metal slug is comprised of a metal selected from a group consisting of 2017-T4, 2024-T4, 2117-T4, and 7050-T73 type aluminum alloys.

28. The method of claim 21 wherein said tapered opening has a polished conical surface, said shank cylindrical opening has a polished shank cylindrical surface, and said solid metal rivet is further characterized by the surfaces of the shank and the tapered region being suitable for making a fluid tight assembly.

29. The method of claim 28 further comprising shaving the slug cylindrical surface of the metal slug whereby the slug cylindrical surface is substantially free of longitudinal surface defects.

30. A method of producing a fatigue resistant, solid metal rivet comprising:

providing an extrusion die, said extrusion die
- having a head portion defining a head cylindrical opening with a head diameter,
- having a tapered portion defining a tapered opening extending from the head cylindrical opening, and having a shank portion defining a shank cylindrical opening extending from the tapered opening;

providing a metal slug having a slug cylindrical surface, having a uniform slug diameter approximately equal to the head diameter, and having a grain oriented substantially longitudinally along the axis of the metal slug;

extruding the metal slug through the extrusion die from the head portion, through the tapered portion, and into the shank portion to form a solid metal rivet having a head with the head diameter, a shank with a shank diameter, and connected by a tapered region;

said solid metal rivet being characterized by a grain structure variation that is substantially the same along lines substantially parallel to the common axis of the head, the shank, and the tapered region.

31. The method of claim 30 wherein said tapered opening has an included angle in a range of 80° to 85°.

32. The method of claim 30 wherein said shank diameter is between 77% and 87% of the head diameter.

33. The method of claim 30 wherein said metal slug has a grain size of 6 or finer when measured in accordance with specification ASTM E 112.

34. The method of claim 30 wherein said metal slug is comprised of a metal selected from a group consisting of aluminum and aluminum alloys.

35. The method of claim 30 wherein said metal slug is comprised of a metal selected from a group consisting of 2017, 2024, 2117, and 7050 type aluminum alloys.

36. The method of claim 30 wherein said metal slug is comprised of a metal selected from a group consisting of 2017-T4, 2024-T4, 2117-T4, and 7050-T73 type aluminum alloys.

37. The method of claim 30 wherein said tapered opening has a polished conical surface, said shank cylindrical opening has a polished shank cylindrical surface, and said solid metal rivet is further characterized by the surfaces of the shank and the tapered region being suitable for making a fluid tight assembly.

38. The method of claim 37 further comprising shaving the slug cylindrical surface of the metal slug whereby the slug cylindrical surface is substantially free of longitudinal surface defects.

* * * * *